US010165365B2

(12) United States Patent
Kim et al.

(10) Patent No.: US 10,165,365 B2
(45) Date of Patent: Dec. 25, 2018

(54) SOUND SHARING APPARATUS AND METHOD

(71) Applicant: SAMSUNG SDS CO., LTD., Seoul (KR)

(72) Inventors: Sang-Bum Kim, Seoul (KR); Sang-Bum Cho, Seoul (KR); Jun-Ho Kang, Seoul (KR)

(73) Assignee: SAMSUNG SDS CO., LTD., Seoul (KR)

( * ) Notice: Subject to any disclaimer, the term of this patent is extended or adjusted under 35 U.S.C. 154(b) by 0 days.

(21) Appl. No.: 15/889,755

(22) Filed: Feb. 6, 2018

(65) Prior Publication Data

US 2018/0227671 A1 Aug. 9, 2018

(30) Foreign Application Priority Data

Feb. 6, 2017 (KR) ..... 10-2017-0016305

(51) Int. Cl.
*H04R 3/12* (2006.01)
*G10L 21/0232* (2013.01)
*G10L 21/0208* (2013.01)

(52) U.S. Cl.
CPC ..... *H04R 3/12* (2013.01); *G10L 21/0232* (2013.01); *G10L 2021/02082* (2013.01)

(58) Field of Classification Search
None
See application file for complete search history.

(56) References Cited

U.S. PATENT DOCUMENTS

2016/0006879 A1* 1/2016 Dickins ..... H04M 9/085 379/406.03
2017/0127145 A1* 5/2017 Rajapakse ..... H04N 21/6125

* cited by examiner

*Primary Examiner* — Paul Huber
(74) *Attorney, Agent, or Firm* — Sughrue Mion, PLLC

(57) ABSTRACT

Disclosed are a sound sharing apparatus and a sound sharing method. The sound sharing apparatus according to one embodiment of the present disclosure includes at least one processor configured to implement: a modifier configured to change a default audio render driver of a local machine from a first audio render driver to a second audio render driver; a capturer configured to capture audio data transmitted to the second audio render driver; and a mixer configured to mix the captured audio data: i) with first voice data to output first mixed data, wherein the first voice data is received from a remote machine connected to the local machine through a network, or ii) with second voice data to output second mixed data, wherein the second voice data is received input through a microphone of the local machine.

13 Claims, 6 Drawing Sheets

SOUND SHARING APPARATUS AND METHOD

CROSS-REFERENCE TO RELATED APPLICATION

This application claims priority to and the benefit of Korean Patent Application No. 10-2017-0016305, filed on Feb. 6, 2017, the disclosure of which is incorporated herein by reference in its entirety.

BACKGROUND

1. Field

Embodiments of the present disclosure relate to a technique for sharing a sound in a voice communication system which provides services such as web conferencing and the like.

2. Discussion of Related Art

Web conferencing is an online service capable of hosting real-time meetings, conferences, presentations, and trainings through the Internet. Generally, sharing of voice content, image content, and the like in such web conferencing may greatly help a conference proceed, and various content sharing efforts are being made.

However, when a moving picture experts group 4 (MPEG-4) video prepared in advance is shared, there is a troublesome problem in that a device for streaming the video and a player for reproducing audio data being streamed need to be separately implemented at both the sender's end and the receiver's end in addition to an existing voice channel. Furthermore, in such a situation, there is a problem in that sharing of the video and the like, which is already being streamed through a web browser and the like, is impossible.

Furthermore, as another method of content sharing, there is a method of capturing data transmitted from an operating system to an audio render driver and transmitting the captured data to the other party, but in this case, since the captured data includes voice data transmitted from the other party, there is a problem in that the other party has to rehear what they spoke. In order to resolve the above-described problem, there has been proposed a method of removing the voice data of the other party from the captured data using an acoustic echo canceller (AEC), but in this case, distortion may occur in sound (i.e., the captured data) to be shared.

SUMMARY

Embodiments of the present disclosure provide a means for efficiently sharing sound in an environment in which a local machine and a remote machine are connected via a network.

According to an exemplary embodiment of the present disclosure, there is provided a sound sharing apparatus including at least one processor configured to implement: a modifier configured to change a default audio render driver of a local machine from a first audio render driver to a second audio render driver; a capturer configured to capture audio data transmitted to the second audio render driver; and a mixer configured to mix the captured audio data: i) with first voice data to output first mixed data, wherein the first voice data is received from a remote machine connected to the local machine through a network, or ii) with second voice data to output second mixed data, wherein the second voice data is received through a microphone of the local machine.

The mixer may output the first mixed data to the first audio render driver.

The first audio render driver may be configured to drive a speaker of the local machine.

The sound sharing apparatus may be configured to transmit the second mixed data to the remote machine through the network.

The at least one processor may further implement a resampler configured to change a sampling rate of the captured audio data to that of the first audio render driver or to that of the second voice data.

According to another exemplary embodiment of the present disclosure, there is provided a computing device including one or more processors; memory; and one or more programs, wherein the one or more programs are stored in the memory and configured to be executed by the one or more processors, the one or more programs including instructions for: changing a default audio render driver of a local machine from a first audio render driver to a second audio render driver; capturing audio data transmitted to the second audio render driver; and mixing the captured audio data: i) with first voice data to output first mixed data, wherein the first voice data is received from a remote machine connected to the local machine through a network, or ii) with second voice data to output second mixed data, wherein the second voice data is received through a microphone of the local machine.

According to still another exemplary embodiment of the present disclosure, there is provided a sound sharing method which is executed in a computing device including one or more processors and including a memory storing one or more programs executed by the one or more processors, the method including changing a default audio render driver of a local machine from a first audio render driver to a second audio render driver; capturing audio data transmitted to the second audio render driver; and mixing the captured audio data: i) with first voice data to output first mixed data, wherein the first voice data is received from a remote machine connected to the local machine through a network, or ii) with second voice data to output second mixed data, wherein the second voice data is received through a microphone of the local machine.

The sound sharing method may further include, outputting the first mixed data to the first audio render driver.

The first audio render driver may be configured to drive a speaker of the local machine.

The sound sharing method may further include transmitting the second mixed data to the remote machine through the network.

The sound sharing method may further include, before the mixing the captured audio data with the first voice data, changing, by a resampler a sampling rate of the captured audio data to that of the first audio render driver, before the mixing the captured audio data with the second voice data, changing, by the resampler, the sampling rate of the captured audio data to that of the second voice data.

The captured audio data may comprise audio data generated in the computing device, and the captured audio data excludes the first voice data and the second voice data.

The captured audio data, by excluding the first voice data and the second voice data, may reduce an acoustic echo phenomenon at the remote machine.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION OF EXEMPLARY EMBODIMENTS

Hereinafter, specific embodiments of the present disclosure will be described with reference to the accompanying drawings. The following detailed description is provided to help a comprehensive understanding of methods, apparatuses, and/or systems described herein. However, these are merely illustrative embodiments, and the present disclosure is not limited thereto.

In the following description of embodiments of the present disclosure, if a detailed description of the known related art is determined to obscure the gist of the present disclosure, the detailed description thereof will be omitted. Further, all terms used hereinafter are defined by considering functions in the present disclosure, and meanings thereof may be different according to a user, the intent of an operator, or custom. Therefore, the definitions of the terms used herein should follow contexts disclosed herein. The terms used herein are used to describe the embodiments and are not intended to restrict and/or limit the present disclosure. Unless the context clearly dictates otherwise, the singular form includes the plural form. In this description, the terms "comprising," "having," or the like are used to specify that a feature, a number, a step, an operation, a component, an element, or a combination thereof described herein exists, and they do not preclude the presence or addition of one or more other features, numbers, steps, operations, components, elements, or combinations thereof.

Figure 1:
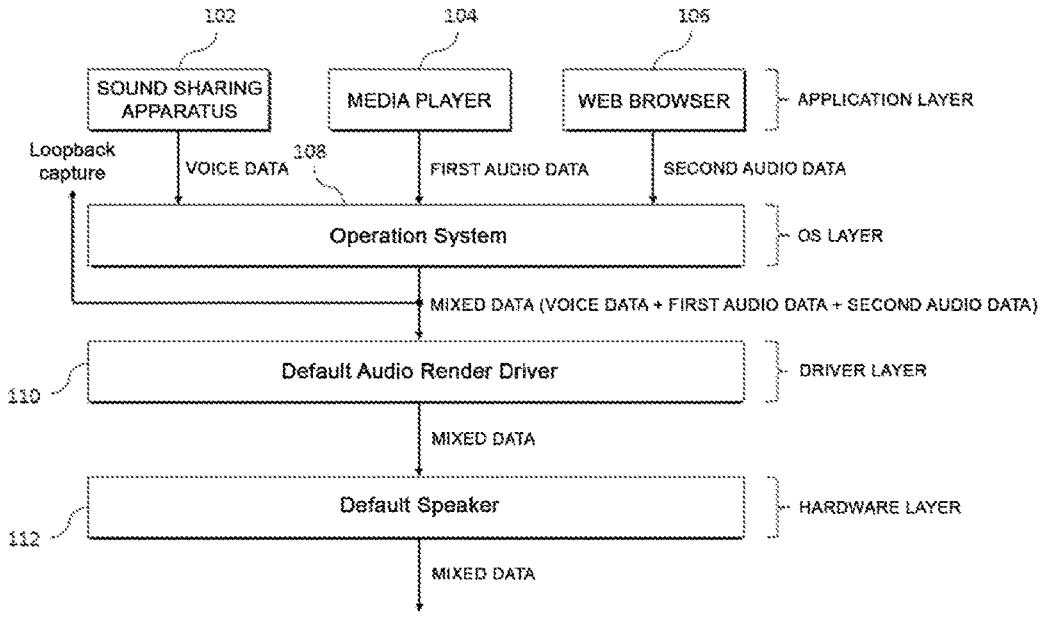
FIG. 1 is an exemplary diagram for describing a loopback capture interface used in a voice communication system.

FIG. 1 is an exemplary diagram for describing a loopback capture interface used in a voice communication system. In the embodiments of the present disclosure, the voice communication system is used to collectively refer to various types of network-based audio-based communication systems such as voice calling, multi-party voice conferencing, and the like. Further, the voice communication system is not limited to a communication system using only audio, but may also include a communication system such as a two-party video calling, multi-party video conferencing, and the like in which audio is included as a part of a communication means. That is, it is noted that the embodiments of the present disclosure are not limited to a communication system of a specific type or method.

Referring to FIG. 1, various applications or hardware devices related to sound reproduction may be present in a local machine used by a participant in voice communication. As one example, the local machine may include a sound sharing apparatus 102, a media player 104, a web browser 106, and the like. The sound sharing apparatus 102 may be a hardware device having a dedicated application for multi-party voice communication or be a computer readable recording medium for executing the applications, and may transmit a playback request for audio data of the other party, which is received from a remote machine, to an operating system 108. Further, the media player 104 may transmit a playback request for first voice data in the terminal to the operating system 108, and the web browser 106 may transmit a playback request for second voice data online to the operating system 108. For example, the first voice data may be a music file stored in the terminal, and the second voice data may be sound content which is reproducible online.

The operating system 108 may mix the audio data, the first voice data, and the second voice data to transmit the mixed data to a default audio render driver 110, and the default audio render driver 110 may transmit the mixed data, in which the audio data, the first voice data, and the second voice data have been mixed, to a default speaker 112. Thereafter, the default speaker 112 may output the mixed data. Here, the default audio render driver 110 refers to an audio render driver which is set to be used by default by a local machine among one or more audio render drivers in the local machine, and the default speaker 112 refers to a speaker which is set to be used by default by the local machine among speakers in the local machine.

At this point, the operating system 108 may provide a loopback capture interface. An application developer may capture a sound transmitted to the default audio render driver 110 through the loopback capture interface provided by operating system 108.

However, when the loopback capture interface is used, the first voice data and the second voice data and also the audio data of the other party, which is transmitted through the sound sharing apparatus 102, are mixed and captured. When such captured mixed data is shared with the other party, the other party has to rehear what they spoke. That is, in this case, an acoustic echo phenomenon occurs.

Figure 2:
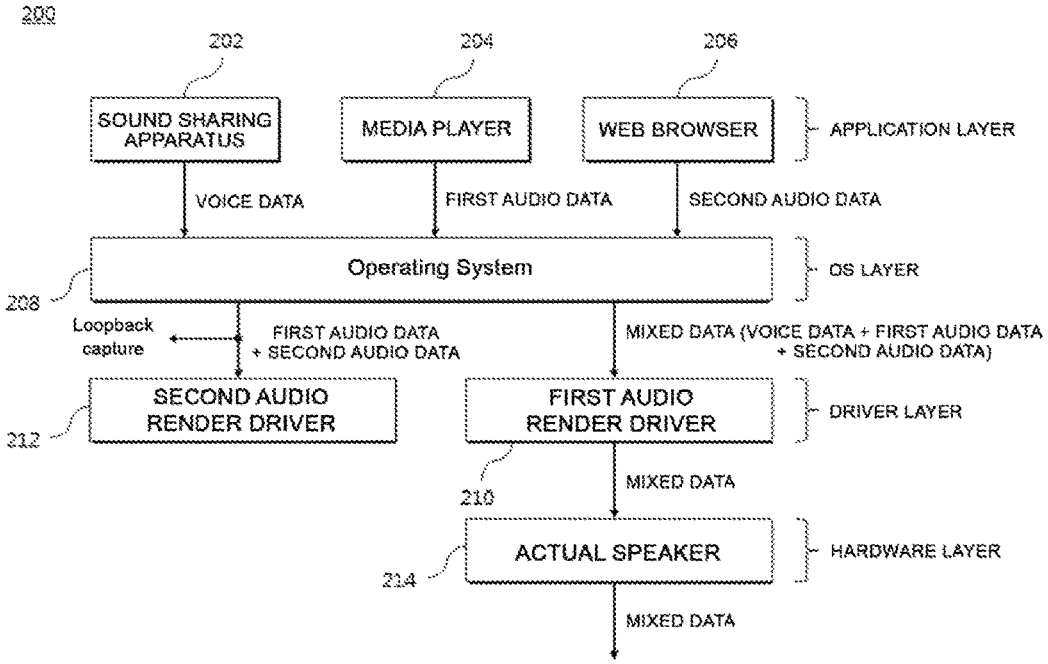
FIG. 2 is an exemplary diagram for describing a process of capturing audio data at a terminal according to one embodiment of the present disclosure.

FIG. 2 is an exemplary diagram for describing a process of capturing audio data at a terminal 200 (i.e., the local machine) according to one embodiment of the present disclosure. As shown in FIG. 2, various applications or hardware devices related to sound reproduction may be present in the terminal 200 according to one embodiment of the present disclosure. As one example, the terminal 200 may include a sound sharing apparatus 202, a media player 204, a web browser 206, and the like. As described above, the sound sharing apparatus 202 may be a hardware device having a dedicated application for a multi-party voice communication or be a computer readable recording medium for executing the dedicated application. Further, the media player 204 and the web browser 206 may transmit a playback request for various audio data to an operating system 208.

Furthermore, a first audio render driver 210 and a second audio render driver 212 may be installed at the terminal 200 according to one embodiment of the present disclosure. Here, the first audio render driver 210 may be an actual audio render driver configured to drive a speaker 214 (a hardware device) of the terminal 200, and the second audio render driver 212 may be a virtual audio render driver configured to drive a virtual speaker. For example, the second audio render driver 212 may be distributed from a server (not shown) together with the dedicated application for multi-party voice communication to be installed in the terminal 200. Meanwhile, before the second audio render driver 212 is installed, the first audio render driver 210 may be set as a default audio render driver of the terminal 200.

When a sound is shared, the sound sharing apparatus 202 may change the default audio render driver of the operating system 208 in the terminal 200 from the first audio render driver 210 to the second audio render driver 212. As one example, the sound sharing apparatus 202 may initiate a sound sharing service by executing the dedicated application for multi-party voice communication according to a request of a user, and when initiating the sound sharing service, the sound sharing apparatus 202 may change the default audio render driver from the first audio render driver 210 to the second audio render driver 212. In this case, the remaining applications, i.e., the media player 204, the web browser 206, and the like but not the dedicated application in the sound sharing apparatus 202, may transmit audio data to be reproduced, i.e., the first voice data, the second audio date, and the like to the second audio render driver 212 which is the default audio render driver. At this point, the sound sharing apparatus 202 may originally output voice data of the other party, which is received from another terminal (not shown), that is, the remote machine, to the first audio render driver 210.

Thereafter, the sound sharing apparatus 202 may capture the audio data transmitted to the second audio render driver 212. As one example, the sound sharing apparatus 202 may capture the audio data (e.g., the first voice data and the second voice data) transmitted to the second audio render driver 212 using the above-described loopback capture interface. In this case, all the audio data generated in the terminal 200 may be fundamentally separated from the voice data transmitted through the sound sharing apparatus 202. Consequently, the audio data of the other party may not be included in the captured audio data, and the sound sharing apparatus 202 may transmit the captured audio data to the remote machine through the network. The remote machine may be connected to the terminal 200 (i.e., the local machine) through the network. Here, the network may include any type of communication networks capable of performing packet communications including a mobile communication network such as a third-generation (3G) or long-term evolution (LTE) network, wired or wireless Internet networks, and the like.

As described above, when the captured audio data is shared with the other party, the acoustic echo phenomenon does not occur. Further, when the terminal 200 receives voice data from a user through a microphone (not shown), the sound sharing apparatus 202 may mix the voice data with the captured audio data to generate mixed data and transmit the mixed data to the remote machine.

Furthermore, the sound sharing apparatus 202 may mix the captured audio data with the audio data of the other party received from the remote machine and may output mixed data to the first audio render driver 210. As described above, since the second audio render driver 212 is the virtual audio render driver, the second audio render driver 212 is not actually connected to the speaker 214. Accordingly, the sound sharing apparatus 202 may mix the captured audio data with the audio data of the other party, which is received from the remote machine, to output the mixed data to the first audio render driver 210, and the first audio render driver 210 may transmit the mixed data in which the captured audio data and the audio data of the other party have been mixed to the speaker 214. Thereafter, the speaker 214 may output the mixed data, and the user may hear the mixed data.

Figure 3:
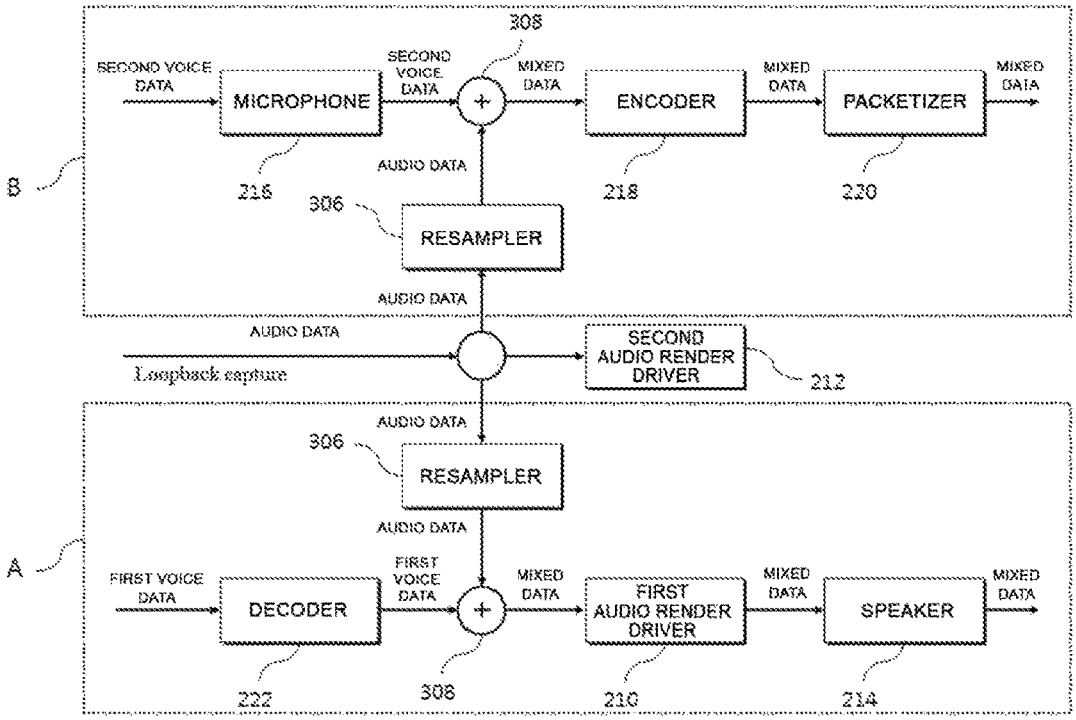
FIG. 3 is an exemplary diagram for describing a process of processing the audio data captured at the terminal according to one embodiment of the present disclosure.

FIG. 3 is an exemplary diagram for describing a process of processing the captured audio data at the terminal 200 according to one embodiment of the present disclosure. Here, the first voice data is the voice data of the other party, which is received from the remote machine connected to the local machine through the network, and the mixed data shown in a portion A of FIG. 3 is data provided to the user of the local machine. Further, the second voice data is the audio data of the user, which is input through the microphone of the local machine, and the mixed data shown in a portion B of FIG. 3 is data provided to the other party (i.e., a user of the remote machine). At this point, it is assumed that the audio data generated at the terminal 200 is transmitted to the second audio render driver 212, and the audio data transmitted to the second audio render driver 212 is captured through the loopback capture interface.

Referring to the portion A of FIG. 3, a decoder 222 may decode the first voice data received from the remote machine. Further, since a sampling rate of the first audio render driver 210 may be different from that of the second audio render driver 212, a resampler 306 may change a sampling rate of the captured audio data to the sampling rate of the first audio render driver 210. Thereafter, a mixer 308 may mix the first voice data passed through the decoder 222 with the audio data passed through the resampler 306 and generate mixed data to output the mixed data to the first audio render driver 210. The first audio render driver 210 may transmit the mixed data to the speaker 214. The speaker 214 may output the mixed data, and the user may hear the mixed data.

Further, referring to the portion B of FIG. 3, a microphone 216 may receive second voice data from the user of the local machine. Furthermore, since the sampling rate of the second audio render driver 212 may be different from that of the second voice data input from the microphone 216, the resampler 306 may change the sampling rate of the captured audio data to that of the second voice data. Thereafter, the mixer 308 may mix the second voice data input from the microphone 216 with the audio data passed through the resampler 306 and generate mixed data to output the mixed data to an encoder 218. The encoder 218 may encode the mixed data and transmit the encoded data to a packetizer 220. The packetizer 220 may packetize the encoded mixed data. Thereafter, each packet may be transmitted to the remote machine via a network (e.g., an existing voice channel) to which the terminal 200 (i.e., the local machine) and the remote machine are connected. Here, the voice channel may be the same as a voice channel through which the first voice data is transmitted.

Figure 4:
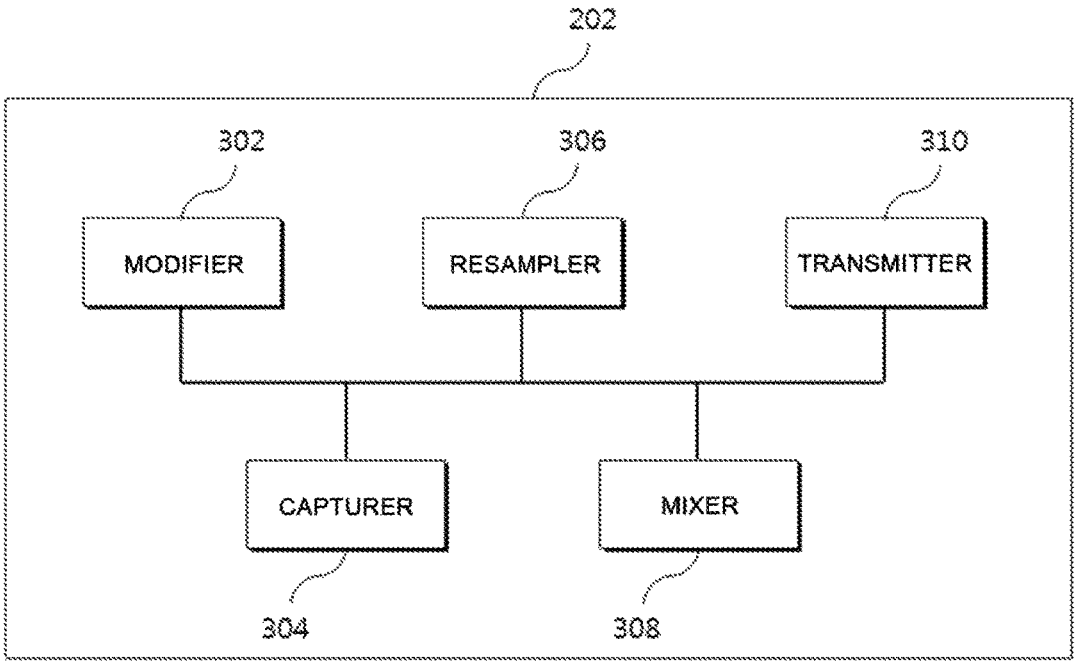
FIG. 4 is a block diagram illustrating a detailed configuration of a sound sharing apparatus according to one embodiment of the present disclosure.

FIG. 4 is a block diagram illustrating a detailed configuration of the sound sharing apparatus 202 according to one embodiment of the present disclosure. As shown in FIG. 4, the sound sharing apparatus 202 according to one embodiment of the present disclosure includes a modifier 302, a capturer 304, a resampler 306, a mixer 308, and a transmitter 310.

The modifier 302 changes the default audio render driver of the terminal 200 (i.e., the local machine) from the first audio render driver 210 to the second audio render driver 212. As described above, the first audio render driver 210 may be the actual audio render driver configured to drive the speaker 214 of the terminal 200, and the second audio render driver 212 may be the virtual audio render configured to actually drive the speaker 214. In this case, all the audio data, except for the audio data transmitted through the sound sharing apparatus 202, may be transmitted to the second audio render driver 212 which is the default audio render driver.

The capturer 304 captures the audio data transmitted to the second audio render driver 212. As one example, the capturer 304 may capture the audio data transmitted to the second audio render driver 212 using the loopback capture interface. In this case, all the audio data generated in the terminal 200 may be fundamentally separated from the voice data transmitted through the sound sharing apparatus 202.

The resampler 306 adjusts a sampling rate of the captured audio data. As one example, the resampler 306 may change the sampling rate of the captured audio data to that of the first audio render driver 210. As another example, the resampler 306 may change the sampling rate of the captured audio data to that of the second voice data.

The mixer 308 mixes the captured audio data with the audio data to generate mixed data. As one example, the mixer 308 may mix the first voice data received from the remote machine with the captured audio data and generate mixed data to output the mixed data to the first audio render driver 210. As another example, the mixer 308 may mix the captured audio data with the second voice data input through the microphone of the local machine and generate mixed data to output the mixed data to the encoder 218.

The transmitter 310 transmits each packet of the mixed data passed through the encoder 218 and the packetizer 220 to the remote machine. At this point, the transmitter 310 may transmit each packet to the remote machine through a server providing a dedicated application for multi-party voice communication. Here, each packet may be transmitted to the remote machine through a network to which the terminal 200 (i.e., the local machine) and the remote machine are connected.

Figure 5:
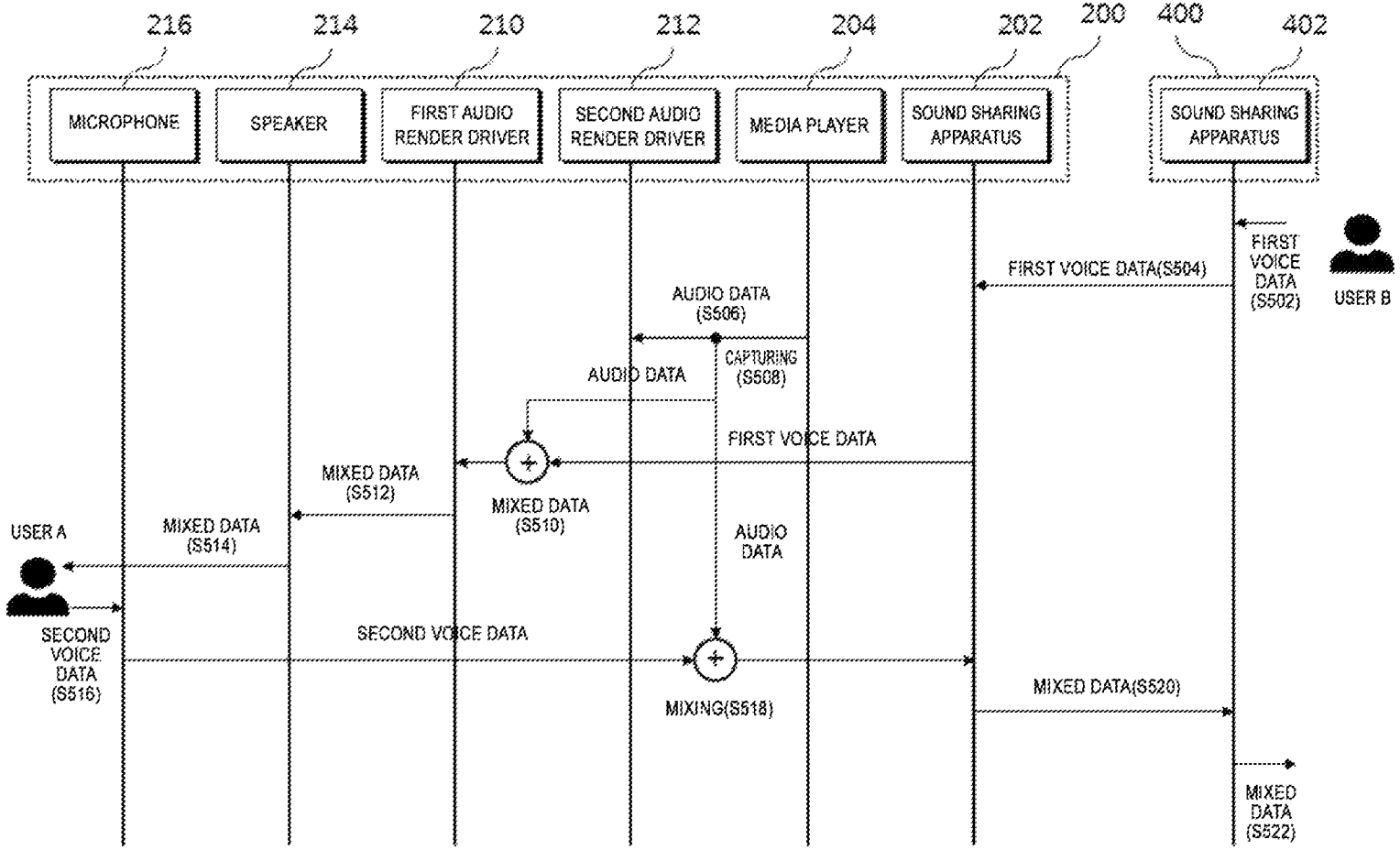
FIG. 5 is an exemplary flowchart for describing a sound sharing method according to one embodiment of the present disclosure.

FIG. 5 is an exemplary flowchart for describing a sound sharing method according to one embodiment of the present disclosure. In the illustrated flowchart, the method is described as being divided into a plurality of operations, but at least some of the operations may be performed in an altered order, may be integrally performed by being combined with other operations, may be omitted, may be performed by being divided into sub-operations, or may be performed with one or more additional operations which are not illustrated.

Further, although not shown in the drawing, the sound sharing apparatus 202 may initiate a sound sharing service by executing a dedicated application for a multi-party voice communication provided from a server according to a request of a user (e.g., a user A), and, when the sound sharing service is initiated, the sound sharing apparatus 202 may change the default audio render driver of the local machine 200 to the second audio render driver 212. In FIG. 5, it is assumed that the default audio render driver of the local machine 200 has already been changed from the first audio render driver 210 to the second audio render driver 212. Hereinafter, a detailed flow of the sound sharing method according to one embodiment of the present disclosure is as follows.

In an operation S502, a sound sharing apparatus 402 of a remote machine 400 receives first voice data from a user B.

In an operation S504, a sound sharing apparatus 402 of the remote machine 400 transmits the first sound data to the sound sharing apparatus 202 of the local machine 200. At this point, the sound sharing apparatus 402 of the remote machine 400 may transmit the first sound data to the sound sharing apparatus 202 of the local machine 200 through the server.

In an operation S506, the media player 204 transmits audio data to the second audio render driver 212 which is a default audio render driver. For convenience of a description, although the media player 204 is shown to generate the audio data in FIG. 5, the audio data may be generated by a module instead of the media player 204, in which case the operation S506 may be identically performed.

In an operation S508, the sound sharing apparatus 202 captures the audio data transmitted to the second audio render driver 212. As one example, the sound sharing apparatus 202 may capture the audio data transmitted to the second audio render driver 212 using the loopback capture interface.

In an operation S510, the sound sharing apparatus 202 mixes the first voice data with the captured audio data and generates mixed data to output the mixed data to the first audio render driver 210.

In an operation S512, the first audio render driver 210 transmits the mixed data to the speaker 214.

In an operation S514, the speaker 214 outputs the mixed data. Accordingly, the user A may hear the mixed data.

In an operation S516, the microphone 216 receives second voice data from the user A.

In an operation S518, the sound sharing apparatus 202 mixes the second voice data with the captured audio data to generate mixed data.

In an operation S520, the sound sharing apparatus 202 transmits the mixed data to the sound sharing apparatus 402 of the remote machine 400. At this point, the sound sharing apparatus 202 may transmit the mixed data to the sound sharing apparatus 402 of the remote machine 400 through the server. Alternatively, the mixed data may be transmitted to the sound sharing apparatus 402 of the remote machine 400 through a network (for example, an existing voice channel) to which the local machine 200 and the remote machine 400 are connected.

In an operation S522, the sound sharing apparatus 402 of the remote machine 400 may transmit the mixed data to a speaker (not shown) of the remote machine 400, and the speaker of the remote machine 400 may output the mixed data. Consequently, the user B may hear the mixed data.

Figure 6:
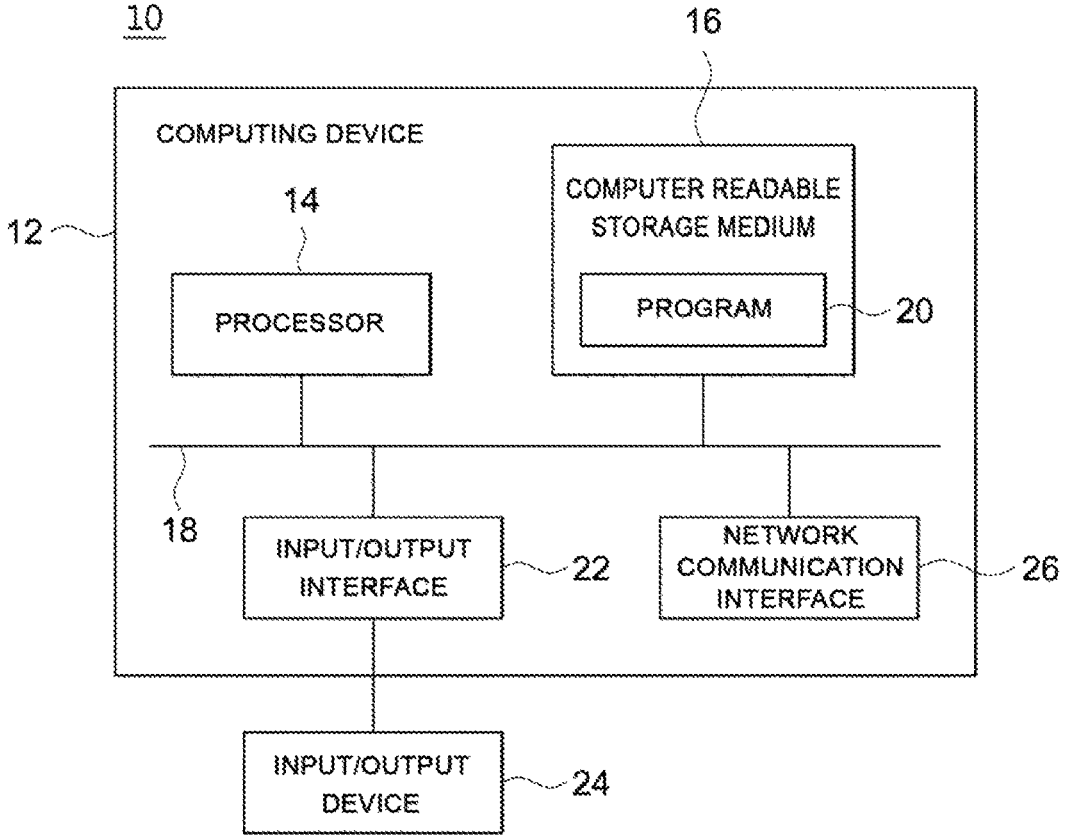
FIG. 6 is a block diagram for describing an example of a computing environment including a computing device suitable for use in exemplary embodiments.

FIG. 6 is a block diagram for describing an example of a computing environment 10 including a computing device suitable for use in exemplary embodiments. In the illustrated embodiment, each component may have different functions and capabilities in addition to those described below, and additional components may be included in addition to components described below.

The illustrated computing environment 10 includes a computing device 12. In one example, the computing device 12 may be the terminal 200, the sound sharing apparatus 202, or one or more components included in the sound sharing apparatus 202.

The computing device 12 includes at least one processor 14, a computer readable storage medium 16, and a communication bus 18. The processor 14 may control the computing device 12 so that the computing device 12 operates according to the above-described exemplary embodiments. For example, the processor 14 may execute one or more programs stored in the computer readable storage medium 16. The one or more programs may include one or more computer-executable commands, and, when the one or more computer-executable commands are executed by the processor 14, the one or more computer-executable commands may be configured to cause the computing device 12 to perform operations according to the exemplary embodiments.

The computer readable storage medium 16 is configured to store computer executable commands, program codes, program data, and/or other suitable forms of information. A program 20 stored in the computer readable storage medium 16 includes a set of commands executable by the processor 14. In one example, the computer readable storage medium 16 may be a memory (a volatile memory such as a random access memory, a non-volatile memory, or a suitable combination thereof), one or more magnetic disk storage devices, optical storage devices, flash memory devices, any other type of storage medium capable of being accessed by the computing device 12 and storing desired information, other types of storage media, or any suitable combination thereof.

The communication bus 18 interconnects various other components of the computing device 12, which include the processor 14 and the computer readable storage medium 16.

The computing device 12 may also include one or more input/output interfaces 22 and one or more network communication interfaces 26 which provide interfaces for one or more input/output devices 24. The Input/output interface 22 and the network communication interface 26 are connected to the communication bus 18. The input/output device 24 may be connected to other components of the computing device 12 through the input/output interface 22. The exemplary input/output device 24 may include an input device such as a pointing device (such as a mouse or a trackpad), a keyboard, a touch input device (such as a touch pad, a touch screen, or the like), a voice or sound input device, and various types of sensor devices and/or imaging devices, and/or may include an output device such as a display device, a printer, a speaker, and/or a network card. The exemplary input/output device 24 may be included inside the computing device 12 as a component constituting the computing device 12, or may be connected to the computing device 12 as a separate device which is distinguished from the computing device 12.

In accordance with the embodiments of the present disclosure, the audio data generated in the terminal and the voice data transmitted through the sound sharing apparatus can be fundamentally separated from each other using the virtual audio render driver such that sound can be easily shared without generation of an acoustic echo and sound distortion. Further, in this case, the sound can be shared through the existing voice channel, and thus an additional channel for sound sharing is not required. Accordingly, a network bandwidth for sound sharing can be saved, and a load on the server can be reduced by minimizing the number of packets transmitted to the server.

Although the present disclosure has been described by way of representative embodiments thereof, it should be understood that numerous modifications can be devised by those skilled in the art that fall within the spirit and scope of this disclosure with respect to the described embodiments. Therefore, the scope of the present disclosure should not be limited to the described embodiments, and it should be determined by not only the appended claims but also equivalents to which such claims are entitled.

What is claimed is:

1. A sound sharing apparatus comprising:

at least one processor configured to implement:

a modifier configured to change a default audio render driver of a local machine from a first audio render driver to a second audio render driver, in response to a playback request from the local machine;

a capturer configured to capture audio data transmitted from a media player of the local machine to the second audio render driver; and a mixer configured to mix the captured audio data: i) with first voice data to output first mixed data, wherein the first voice data is received from a remote machine connected to the local machine through a network, or ii) with second voice data to output second mixed data, wherein the second voice data is received through a microphone of the local machine.

2. The sound sharing apparatus of claim 1, wherein the mixer outputs the first mixed data to the first audio render driver.

3. The sound sharing apparatus of claim 1, wherein:

the first audio render driver is configured to drive a speaker of the local machine.

4. The sound sharing apparatus of claim 1, wherein the sound sharing apparatus is configured to transmit the second mixed data to the remote machine through the network.

5. The sound sharing apparatus of claim 1, wherein the at least one processor further implements a resampler configured to change a sampling rate of the captured audio data to that of the first audio render driver or to that of the second voice data.

6. A computing device, comprising:

one or more processors;

memory; and one or more programs, wherein the one or more programs are stored in the memory and configured to be executed by the one or more processors, the one or more programs including instructions for:

changing a default audio render driver of a local machine from a first audio render driver to a second audio render driver, in response to a playback request from the local machine;

capturing audio data transmitted from a media player of the local machine to the second audio render driver; and mixing the captured audio data: i) with first voice data to output first mixed data, wherein the first voice data is received from a remote machine connected to the local machine through a network, or ii) with second voice data to output second mixed data, wherein the second voice data is received through a microphone of the local machine.

7. A sound sharing method, which is executed in a computing device including one or more processors and including a memory storing one or more programs executed by the one or more processors, the method comprising:

changing a default audio render driver of a local machine from a first audio render driver to a second audio render driver, in response to a playback request from the local machine;

capturing audio data transmitted from a media player of the local machine to the second audio render driver; and mixing the captured audio data: i) with first voice data to output first mixed data, wherein the first voice data is received from a remote machine connected to the local machine through a network, or ii) with second voice data to output second mixed data, wherein the second voice data is received through a microphone of the local machine.

8. The sound sharing method of claim 7 further comprising outputting the first mixed data to the first audio render driver.

9. The sound sharing method of claim 7, wherein:

the first audio render driver is configured to drive a speaker of the local machine.

10. The sound sharing method of claim 7 further comprising transmitting the second mixed data to the remote machine through the network.

11. The sound sharing method of claim 7, further comprising:

before the mixing the captured audio data with the first voice data, changing, by a resampler, a sampling rate of the captured audio data to that of the first audio render driver, before the mixing the captured audio data with the second voice data, changing, by the resampler, the sampling rate of the captured audio data to that of the second voice data.

12. The sound sharing method of claim 7, wherein the captured audio data comprises audio data generated in the computing device, and the captured audio data excludes the first voice data and the second voice data.

13. The sound sharing method of claim 7, wherein the captured audio data, by excluding the first voice data and the second voice data, reduces an acoustic echo phenomenon at the remote machine.

* * * * *